US005664971A

United States Patent [19]

Coy

[11] Patent Number: 5,664,971

[45] Date of Patent: Sep. 9, 1997

[54] TERMINAL BINDING POST

[76] Inventor: John W. Coy, 11838 SW. 256th La., Vashon, Wash. 98070

[21] Appl. No.: 691,879

[22] Filed: Aug. 1, 1996

[51] Int. Cl.[6] ..... H01R 4/36

[52] U.S. Cl. ..... 439/811; 439/791; 439/957

[58] Field of Search ..... 439/810, 811, 439/812, 813, 814, 709, 791, 457

[56] References Cited

U.S. PATENT DOCUMENTS

| | | | |
|---|---|---|---|
| 3,434,103 | 3/1969 | Hancock et al. | 439/812 |
| 4,764,127 | 8/1988 | Price | 434/551 |
| 5,171,160 | 12/1992 | Beins et al. | 439/812 |
| 5,314,360 | 5/1994 | Jaag | 439/811 |

*Primary Examiner*—Neil Abrams
*Assistant Examiner*—T. C. Patel

[57] ABSTRACT

Disclosed is a terminal binding post for selectively mounting a wire, a fork connector and a banana plug which includes: an electrically insulated housing; an electrically conducting contact member received within a cavity of the housing; and a clamping member having an exterior clamping surface and an interior clamping surface defined in a clamping slot for receiving a tab of the contact member. The clamping member and contact member define separate wire receiving and fork connector receiving spaces. An aperture and a slot are defined in the housing which are sized and dimensioned for respectively receiving a wire and a fork connector. The clamping member is moveable in the cavity with respect to the contact member between a wire engaged position in which the clamping member securely engages the wire to the first tab of the contact and a wire disengaged spaced therefrom. The clamping member is also moveable between a fork connector engaged position in which the clamping member securely engages the fork connector to the contact member and a forked connector disengaged position spaced therefrom. Means such as a knob having a shaft threadedly received by the clamping member are included for selectively moving the clamping member. A banana plug receiving aperture is defined in the head and shaft of the knob for providing an electrical connection to the contact member.

16 Claims, 9 Drawing Sheets

TERMINAL BINDING POST

BACKGROUND OF THE INVENTION

1. Field of the Invention

The present invention relates to the field of electrical connectors. More particularly, the invention pertains to terminal binding posts commonly associated with consumer and professional audio/visual electronic equipment for selectively mounting a variety of connectors such as stripped wire, fork connectors and banana plugs to the electronic equipment.

2. Description of the Prior Art

Professional and consumer electronics systems make use of a large variety of separate components. Pieces of equipment may include speakers, amplifiers, tuners, tape decks, compact disk players, receivers, equalizers, video cassette recorders and the like. Each piece of equipment will have to be electrically connected to at least one other piece of equipment. Most of the commonly available pieces of equipment have at least one pair of terminal binding posts for making the electrical connection to at least one of the other pieces of equipment. For example, each speaker will have at least one pair of terminal binding posts for making an electrical connection to a pair of terminal binding posts carried on an amplifier. The terminal binding posts are most often arranged in pairs to make possible both positive and negative connections between two pieces of equipment.

A variety of connectors exist for connecting the wire to the terminal binding post. Electrical connections between the various pieces of equipment are usually made with a copper wire which carries an insulating sheath about its perimeter. Often, the connection to the binding posts will be made using a terminus of the wire from which the insulating sheath has been removed or stripped. In other cases, a fork connector is secured at one or both ends of the wire allowing the wire to be connected to an appropriately designed terminal binding post. In yet other cases, a banana plug is secured at a terminus of the wire to permit connections to be made to terminal binding posts designed to accept this type of connector.

The most commonly used terminal binding post consists of a metallic post having an external thread thereabout and an aperture extending laterally therethrough. An insulated knob is threadedly mounted to the binding post. The knob may be screwed down along the binding post to engage the wire or fork connector against a surface, thereby securing the wire or fork connector in place and increasing the reliability of the connection. When this type of binding post is used, a portion of the stripped end of the wire inserted through the aperture in the binding post will usually extend beyond the insulated knob leaving a portion of the wire exposed. Likewise, a fork connector will often extend beyond the insulated knob and a portion of the fork connector will be exposed.

Existing terminal binding posts often have exposed metal surfaces that are in electrical contact with the load connected through the binding post. The existing designs for terminal binding posts do not ensure that the wires and other connectors, such as fork connectors and banana plugs, do not have exposed portions when attached to the terminal binding post. The exposed portions of the terminal binding posts, as well as the exposed portions of the connectors present a significant safety risk. These exposed pieces are often directly connected to the load. They may be accidentally contacted by individuals when working around the equipment, or by children when playing or by small pets.

Contact with these exposed portions can result in severe injury or even death when significant voltage or electrical potential is being carried in the circuits. International safety regulatory agencies have recognized the severity of the risk by instituting new rules governing the binding posts used on consumer electronics. These rules will require that consumer electronic equipment to carry binding posts which will not permit any contact with exposed metal portions or with the connectors secured to the binding posts.

Additionally, the exposed connectors, such as stripped wiring, can lead to inadvertent short circuiting, which at the least will degrade signal quality and may also cause severe damage to expensive electronic equipment.

There is a demonstrated need in the field of consumer electronic equipment for a terminal binding post which leaves no voltage or electric potential carrying portion of the terminal binding post exposed, and which insures that no portion of the connectors attached thereto will be exposed to accidental contact by persons, pets or other connectors.

SUMMARY OF THE INVENTION

The present invention is a terminal binding post for selectively mounting a wire, a fork connector and a banana plug thereto. The terminal binding post includes a housing, a contact member, a clamping member and means for moving the clamping member relative to the contact member.

The housing is formed of an electrically non-conductive material. The housing has an body portion and a base. A cavity is defined within the body portion of the housing. The housing further defines an aperture in the body portion, the aperture sized and dimensioned to receive a wire therein. A slot is also defined in the body portion of the housing, the slot sized and dimensioned to receive a fork connector therein. The aperture and slot each extend from the exterior of the body portion into the cavity thereof.

The contact member has a first tab and is formed of an electrically conductive material. The contact member may have a second tab spaced from the first tab. The contact member is received within the cavity such that no portion of the contact member is exposed to the exterior of a body portion of the housing. This protects people from accidental contact with the contact member.

The clamping member is received within the cavity for movement therein with respect to the contact member. The clamping member has a clamping slot defined therein which has an interior clamping surface. The first tab is received in the clamping slot such that the interior surface and the first tab define a wire receiving space therebetween. The clamping member and the contact member further define a fork connector receiving space therebetween, the fork connector receiving space being separated from the wire receiving space.

The clamping member is moveable between a wire engaged position in which the clamping member securingly engages the wire against the contact member and a wire disengaged position in which the clamping member is spaced from the wire engaged position. The clamping member is also moveable between a fork connector engaged position in which the clamping member securingly engages the fork connector against the contact member and a fork connector disengaged position in which the clamping member is spaced from the fork connector engaged position.

A wire inserted into the aperture is selectively engagable between the interior clamping surface of the clamping member and the first tab. A fork connector inserted into the slot may be selectively engagable between the exterior clamping surface of the clamping member and the second tab of the contact member. Alternatively, the fork connector inserted into the slot may be selectively engagable between the interior clamping surface of the clamping member and the first tab of the contact member.

The terminal binding post further comprises means for moving the clamping member between the wire engaged position and the wire disengaged position and for moving the clamping member between the fork connector engaged position and the fork connector disengaged position. The means for moving the clamping member relative to the contact member can be a knob having an insulated head and a threaded shaft for threadly engaging the clamping member. Alternatively the moving means may consist of a spring member to bias the clamping member toward the wire and fork connector engaged positions.

Means are also provided for securely mounting a standard banana plug to the terminal binding post. The banana plug mounting means includes a banana plug receiving aperture defined in the head and shaft of the knob. The banana plug receiving aperture is sized and dimensioned to securely receive a banana plug therein. The shaft of the knob is formed of an electrically conducting material and is in contact with the contact member, thereby electrically completing the connection of the banana plug to the terminal binding post.

A first object of the invention is to provide a terminal binding post which permits a wire, a fork connector, and a banana plug to be selectively connected thereto.

A second object of the invention is to provide a terminal binding post which has no load carrying portions exposed.

A third object of the invention is to provide a terminal binding post which ensures that no portion of the connectors selectively mounted thereto are exposed.

DESCRIPTION OF THE PREFERRED EMBODIMENTS

Figure 1:
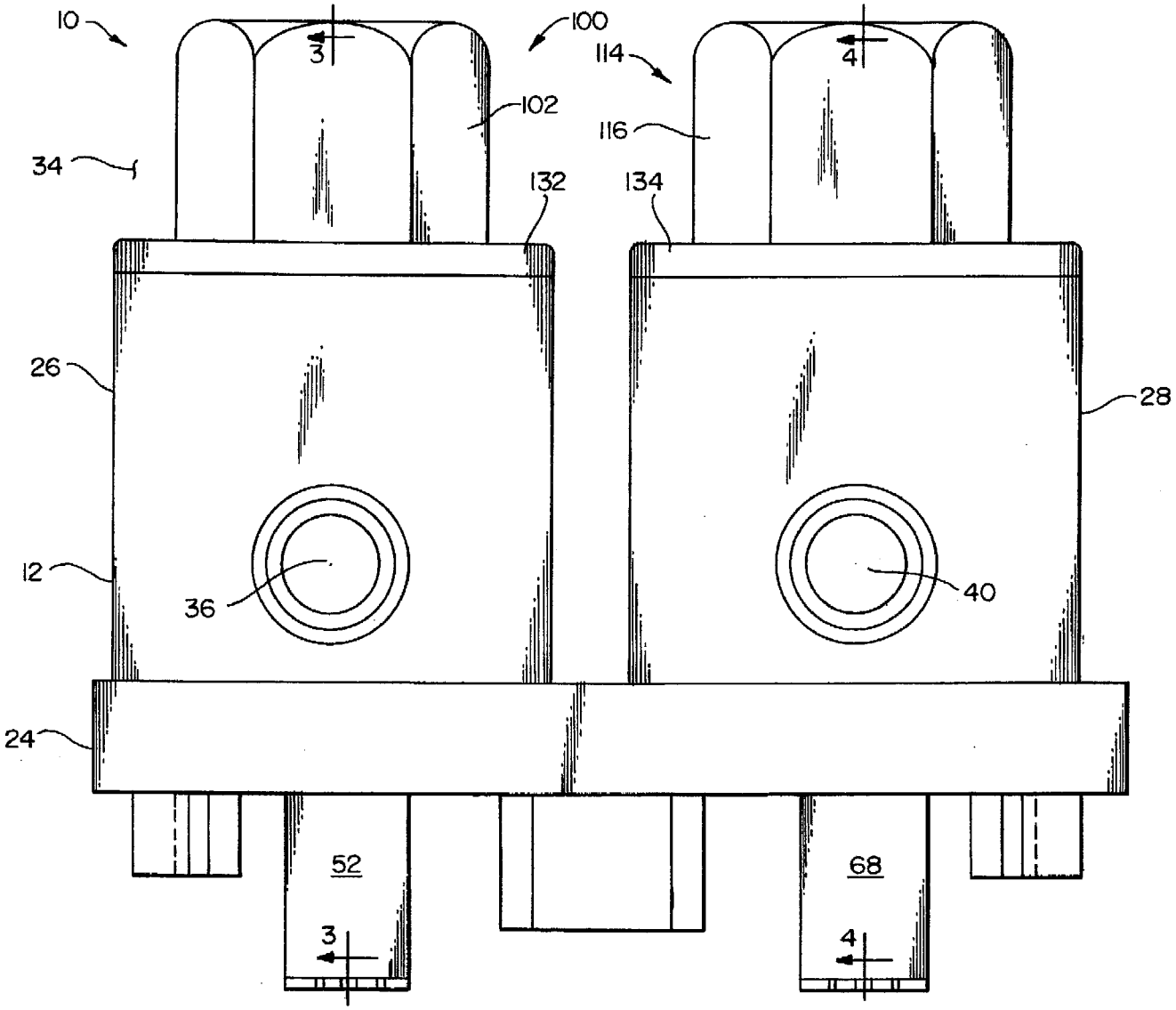
FIG. 1 is a front view of the most preferred embodiment of the terminal binding post, showing the aperture.
Figure 2:
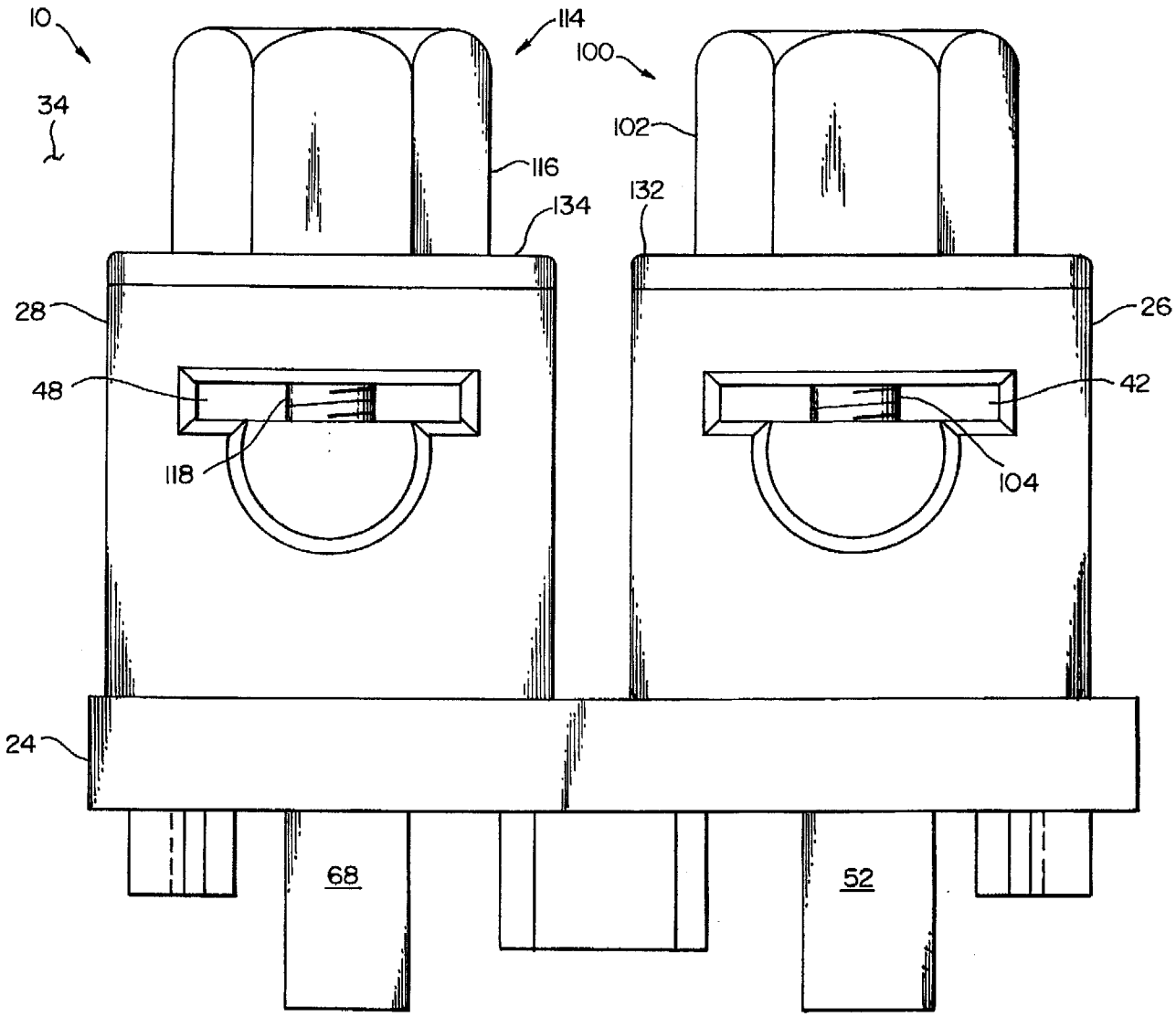
FIG. 2 is a rear view of the terminal binding post of FIG. 1, showing the slot.

With general reference to FIGS. 1–9, a first most preferred embodiment of the invention will be described which allows a pair of wires, a pair of fork connectors and a pair of banana plugs to be selectively mounted to the terminal binding post. A terminal binding post which permits the mounting of a single connector of each of the above types should be considered within the scope of this disclosure, as well as a terminal binding post which permits any multiple of the above listed connectors to be mounted thereto.

The terminal binding post 10 has a housing 12, a first and a second contact member 14, 16, a first and a second clamping member 18, 20 and means for moving the clamping members with respect to the contact members.

The housing 12 is formed from an electrically insulating or non-conductive material. The material chosen should protect persons and stray wires from passage of the current carried through the terminal binding post 10. Polyamide plastic is a suitable material from which to form the housing 12.

With particular reference to FIGS. 3–6, the housing 12 has a perimeter wall 22 and a base 24. The perimeter wall 22 divides the housing 12 into a first body portion 26 and a second body portion 28. The perimeter wall 22 may define the housing 12 into other multiples of body portions where desired to allow for any multiple number of connections to be made to the electronic equipment (not shown). Alternatively, the perimeter wall 22 may define a single body portion, multiple terminal binding posts being provided on the electronic equipment to make the desired connections.

The perimeter wall 22 defines a first cavity 30 in the first body portion 26 and a second cavity 32 in the second body portion 28. The perimeter wall 22 also defines an exterior 34 of the housing 12.

Figure 3:
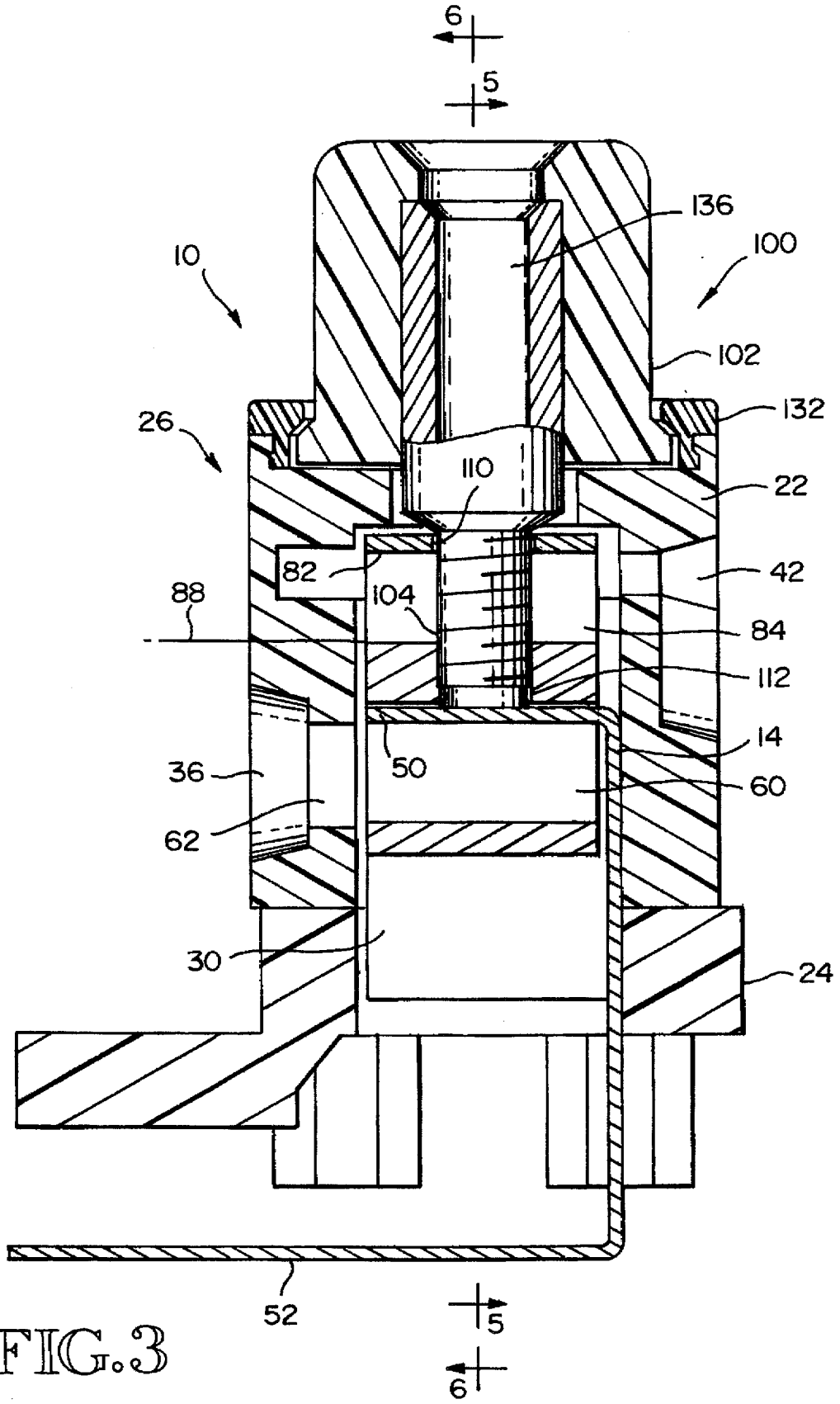
FIG. 3 shows a sectional view of the terminal binding post of FIG. 1 taken along sectional line 3.

With specific reference to FIGS. 1 and 3, a first aperture 36 is defined by the perimeter wall 22 in the first body portion 26 of the housing 12. The first aperture 36 extends between the exterior 34 of the housing 12 and the first cavity 30 of the first body portion 26. The first aperture 36 is sized and dimensioned to receive an insulated wire 38 therein. Use of a wire having a diameter 39 between 0.6 and 5.0 millimeters or of approximately 22-8 gauge is anticipated in the most preferred embodiment.

Figure 4:
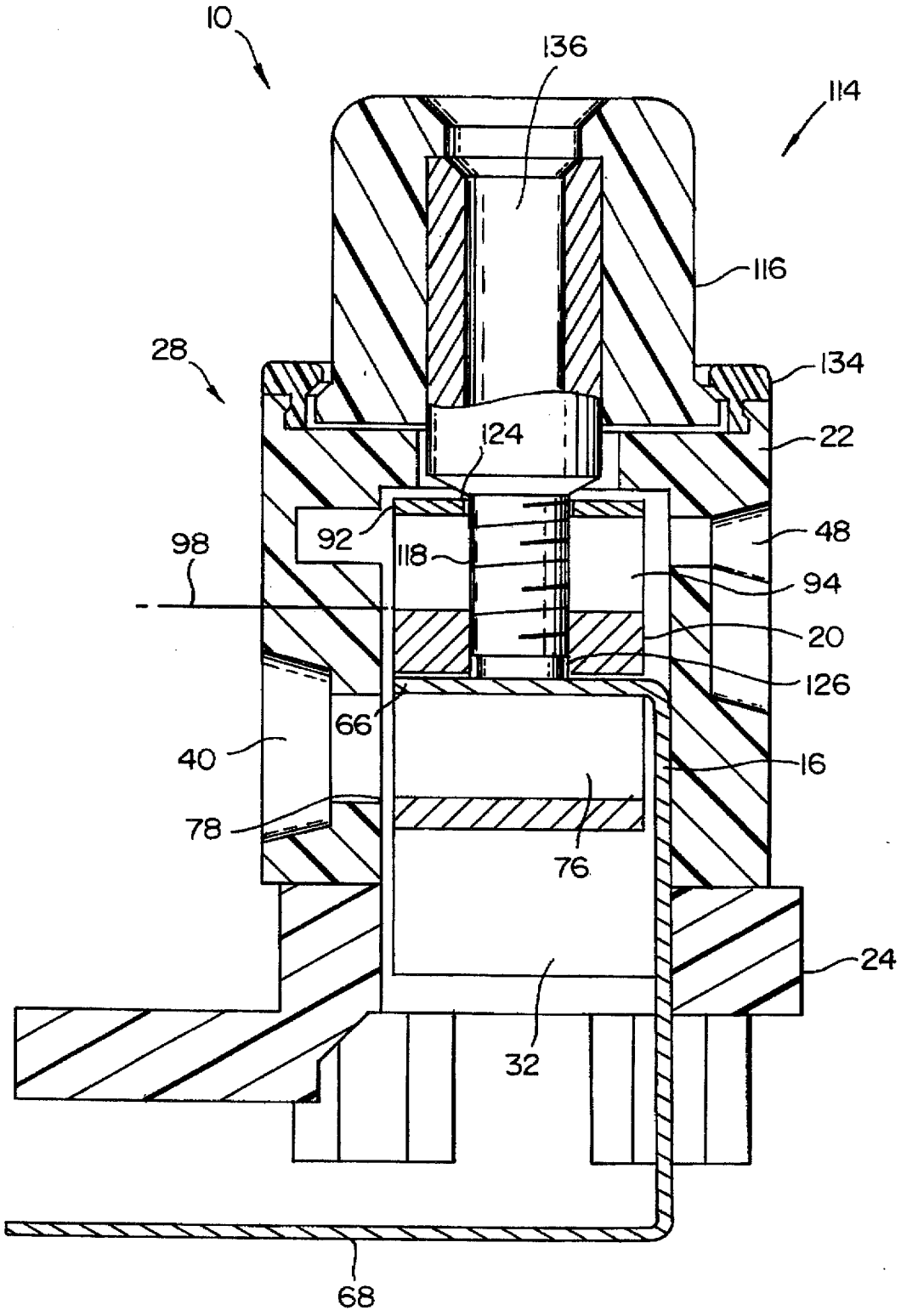
FIG. 4 shows a sectional view of the terminal binding post of FIG. 1 taken along sectional line 4.

With specific reference to FIGS. 1 and 4, a second aperture 40 is likewise defined in the perimeter wall 22 in the second body portion 28 of the housing 12. The second aperture 40 extends from the exterior 34 of the housing 12 and the second cavity 32 of the second body portion 28. The second aperture 40 is also sized and dimensioned to receive an insulated wire therein. Again, a wire having a diameter between 0.6 and 5.0 millimeters is anticipated, although either or both the first and the second apertures 36, 40 can be sized to receive either larger or smaller gauge wire as the application requires.

With reference to FIGS. 2, 3, 5 and 6 a first slot 42 is defined by the perimeter wall 22 in the first body portion 26 of the housing 12. The first slot 42 extends between the exterior 34 of the housing 12 and the first cavity 30 of the first body portion 26. The first slot 42 is sized and dimensioned to receive a fork connector 44 therein, including a portion of the insulated wire to which the fork connector 44 is attached. The first slot 42 is oriented in the first body portion 26 such that it does not intersect with the first aperture 36 of the first body portion 26. In this most preferred embodiment, the first slot 42 is defined in a portion of the perimeter wall 22 opposed to the portion of the perimeter wall 22 in which the first aperture 36 is defined. The first slot 42 is offset from the first aperture 36 along the line of travel 46 of the clamping member 20.

With reference to FIGS. 2, 4, 5 and 6, a second slot 48 is defined by the perimeter wall 22 in the second body portion 28 of the housing 12. The second slot 48 extends between the exterior 34 of the housing 12 and the second cavity 32 of the second body portion 28. The second slot 48 is sized and dimensioned to receive a fork connector 44 therein, including a portion of the insulated wire which the fork connector 44 terminates. The second slot 48 is oriented in the second body portion 28 such that it does not intersect with the second aperture 40 of the second body portion 28. In this most preferred embodiment, the second slot 48 is defined in a portion of the perimeter wall 22 opposed to the portion of the perimeter wall 22 in which the second aperture 40 is defined.

With specific reference to FIGS. 3 and 5–7, the first contact member 14 is received within the first cavity 30 of the first body portion 26. The first contact member 14 is formed of an electrically conductive material. Beryllium copper proves satisfactory for forming the first contact member 14. The first contact member 14 has a first tab 50 extending perpendicularly therefrom. In the most preferred embodiment the first contact member 14 is securely mounted within the first cavity 30. Alternatively, the first contact member 14 could be slidably received in the first cavity 30 for movement with respect to the first body portion 26, however fixing the first contact member 14 with respect to the housing 12 simplifies the construction and operation of the terminal binding post 10. The first contact member 14 is contained within the perimeter wall 22 of the first body portion 26 such that no portion of the first contact member 14 is exposed to the exterior 34 of the first body portion 26.

With general reference to FIGS. 1–7, a portion or lead 52 from the first contact member 14 may extend out of the housing 12 through the base 24 thereof. In use, it is expected that the base 24 will be a printed circuit board which will be affixed adjacent to and inside of the body of a piece of electronic equipment (not shown). Mounting the terminal binding post 10 is such a fashion will ensure that no portion of the first contact member 14 is exposed. In one alternative, a female receptacle (not shown) may be provided for making the electrical connection between the first contact member 14 and the electronic equipment (not shown).

With specific reference to FIGS. 3, 5–7, the first clamping member 18 is received within the first cavity 30 of the first body portion 26 for movement therein with respect to the first contact member 14. The first clamping member 18 has an exterior clamping surface 54. A clamping slot 56 is defined in the first clamping member 18. The clamping slot 56 has an interior clamping surface 58 therein. The clamping slot 56 preferably extends through the first clamping member 18. While it is possible to extend the clamping slot 56 only a portion of the way into the first clamping member 18 this complicates the design of the first contact member 14.

The first tab 50 of the first contact member 14 is received within the clamping slot 56 of the first clamping member 18. The first tab 50 of the first contact member 14 and the interior clamping surface 58 of the first clamping member 18 define a wire receiving space 60 therebetween. The clamping slot 56 of the first clamping member 18, the first tab 50 of the first contact member 14 and the first aperture 36 are arranged in the first body portion 26 such that the wire receiving space 60 is aligned with the first aperture 36 whereby a wire inserted into the first aperture 36 has an unobstructed line of travel into the wire receiving space 60 when the clamping member 18 is in the wire disengaged position 62.

With particular reference to FIGS. 3, 5–6 and 8–9, the first clamping member 18 moves with respect to the first contact member 14 between a wire engaged position 64 and a wire disengaged position 62. In the wire engaged position 64, the interior clamping surface 58 of the first clamping member 18 securely engages the wire 38 inserted into the wire receiving space 60 against the first tab 50 of the first contact member 14. The distance between the interior clamping surface 58 of the first clamping member 18 and the first tab 50 of the first contact member 14 being equal to, or slightly smaller than the undeformed diameter of the wire 38. In the wire disengaged position 62, the interior clamping surface 58 of the first clamping member 18 and the first tab 50 of the first contact member 18 are spaced apart relative to the wire engaged position 64, the distance being somewhat greater than the undeformed diameter 39 of the wire 38.

Figure 5:
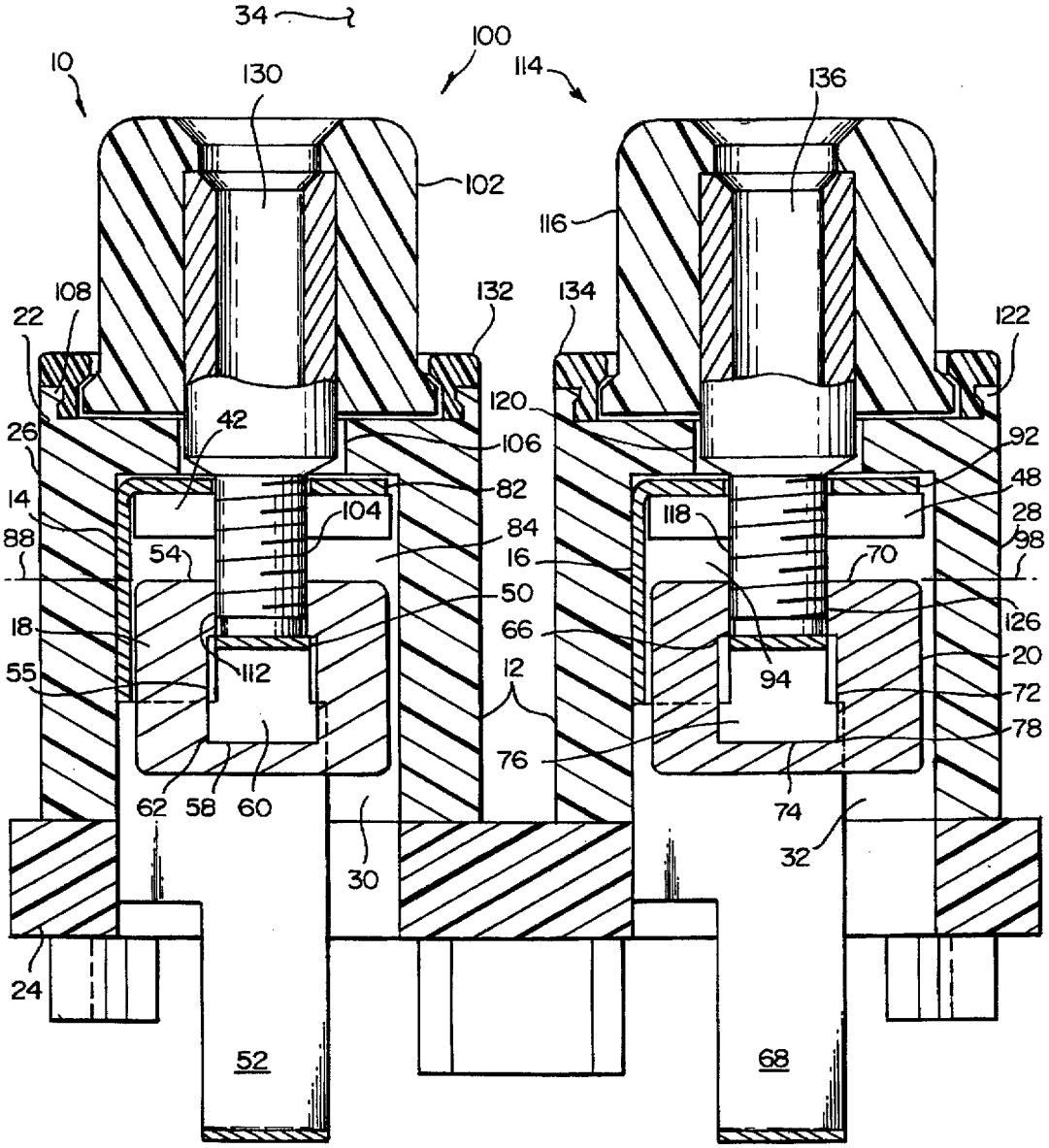
FIG. 5 shows a sectional view of the terminal binding post of FIG. 3 taken along sectional line 5 wherein the clamping member is in both the wire disengaged position and the fork connector disengaged position.
Figure 6:
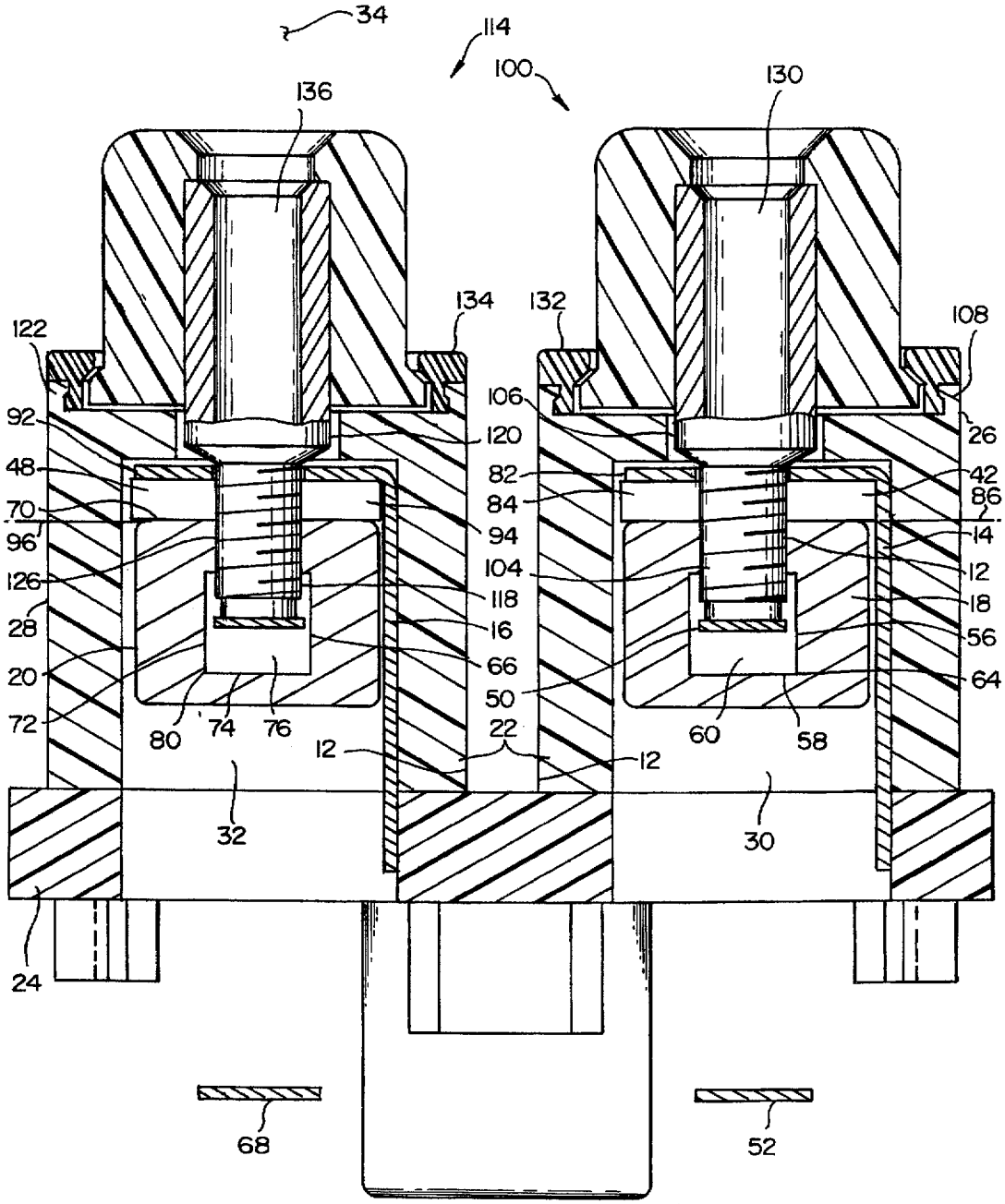
FIG. 6 shows a sectional view of the terminal binding post of FIG. 3 taken along sectional line 6 wherein the clamping member is in both the wire engaged position and the fork connector engaged position.
Figure 7:
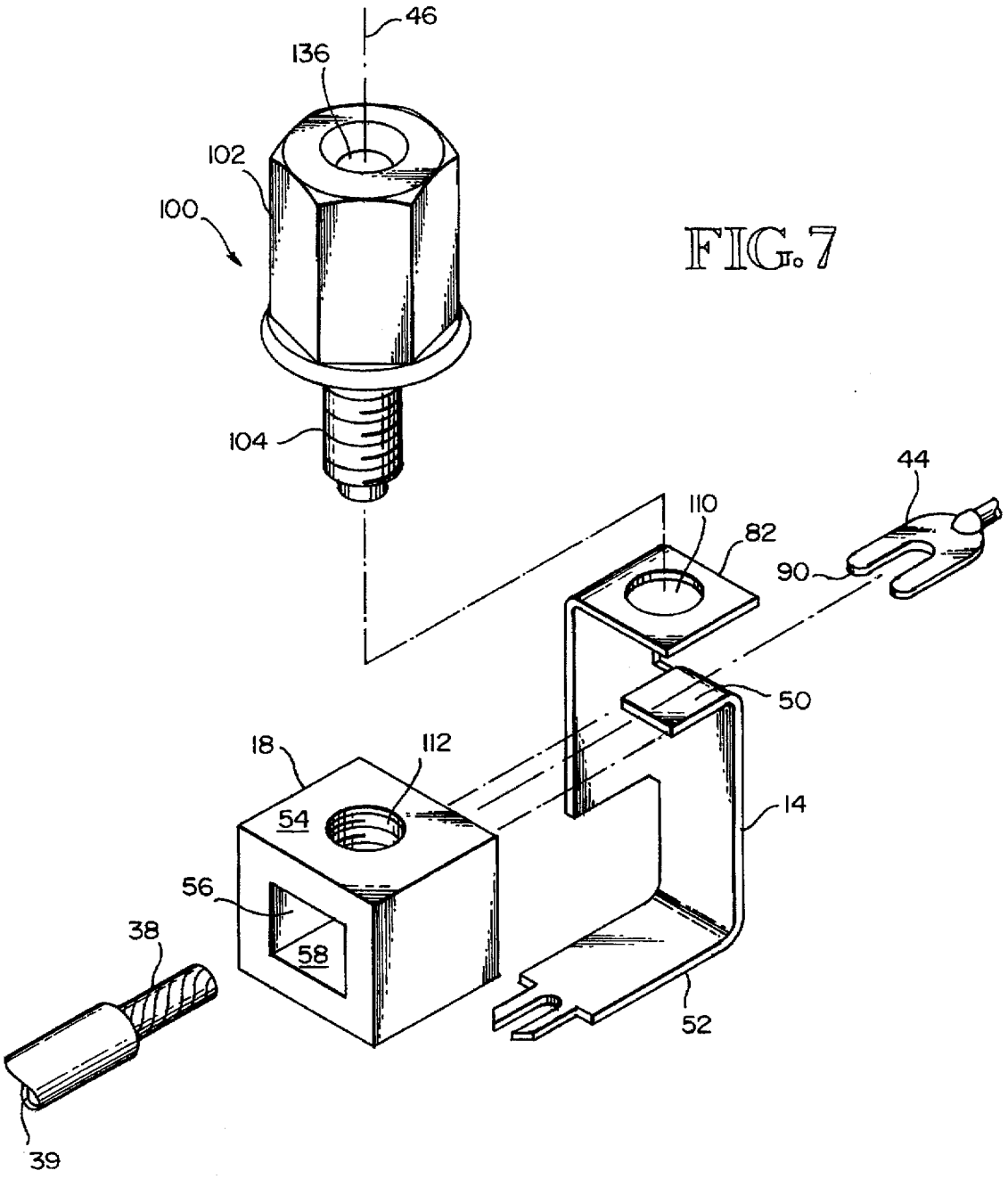
FIG. 7 is an exploded view of the clamping member, contact member, knob, wire and fork connector of the terminal binding post of FIGS. 1–5.

With reference to FIGS. 4–6, a second contact member 16 is received within the second cavity 32 of the second body portion 28. The second contact member 16 is formed of an electrically conductive material. Beryllium copper proves satisfactory for forming the second contact member 16. The second contact member 16 has a first tab 66 extending perpendicularly from the rest of the second contact member 16. In the most preferred embodiment the second contact member 16 is securely mounted within the second cavity 32. Alternatively, the second contact member 16 could be slidably received in the second cavity 32 for movement with respect to the second body portion 28, however fixing the second contact member 16 with respect to the housing 12 simplifies the construction and operation of the terminal binding post 10. The second contact member 16 is contained within the perimeter wall 22 of the second body portion 28 such that no portion of the second contact member 16 is exposed to the exterior 34 of the second body portion 28.

With general reference to FIGS. 1–9, a portion or lead 68 from the second contact member 16 may extend out of the housing 12 through the base 24 thereof as did the first contact member 14.

With specific reference to FIGS. 4–6, the second clamping member 20 is received within the second cavity 32 of the second body portion 28 for movement therein with respect to the second contact member 16. The second clamping member 20 has an exterior clamping surface 70. A clamping slot 72 is defined in the second clamping member 20. The clamping slot 72 has an interior clamping surface 74 therein. The clamping slot 72 preferably extends through the second clamping member 20. While it is possible to extend the clamping slot 72 only a portion of the way into the second clamping member 20 this complicates the design of the second contact member 16.

The first tab 66 of the second contact member 16 is received within the clamping slot 72 of the second clamping member 20. The first tab 66 of the second contact member 16 and the interior surface 74 of the clamping slot 72 of the second clamping member 20 define a wire receiving space 76 therebetween. The clamping slot 72 of the second clamping member 20, the first tab 66 of the second contact member 16 and the second aperture 40 are arranged in the second body portion 28 such that the wire receiving space 76 is aligned with the second aperture 40 whereby a wire inserted into the second aperture 40 has an unobstructed line of travel into the wire receiving space 76 when the second clamping member 20 is in the wire disengaged position 78.

With particular reference to FIGS. 4–6, the second clamping member 20 moves with respect to the second contact member 16 between a wire engaged position 80 and a wire disengaged position 78. In the wire engaged position 80, the interior clamping surface 74 of the second clamping member 20 securely engages a wire inserted into the wire receiving space 76 against the first tab 66 of the second contact member 16. The distance between the interior clamping surface 74 of the second clamping member 20 and the first tab 66 of the second contact member 16 being equal to, or slightly smaller than the undeformed diameter of the wire. In the wire disengaged position 78, the interior clamping surface 74 of the second clamping member 20 and the first tab 66 of the second contact member 16 are spaced apart relative to the wire engaged position 80, the distance being somewhat greater than the undeformed diameter of the wire.

With reference to FIGS. 3, 5–7, in the most preferred embodiment, the first contact member 14 has a second tab 82 extending perpendicularly therefrom. The second tab 82 of the first contact member 14 is spaced from the first tab 50 of the first contact member 14. The second tab 82 of the first contact member 14 and the exterior surface 54 of the first clamping member 18 define a fork connector receiving space 84 therebetween.

With reference to FIGS. 3, 5–9, in addition to being movable between the wire engaged and wire disengaged positions 64, 62, the first clamping member 18 is also movable between a fork connector engaged position 86 and a fork connector disengaged position 88. The exterior clamping surface 54 of the first clamping member 18 securely engages a fork connector 44 inserted into the fork connector receiving space 84 against the second tab 82 of the first contact member 14 in the wire engaged position 86. The distance between the exterior clamping surface 54 of the first clamping member 18 and the second tab 82 of the first contact member 14 being equal to, or slightly smaller than the undeformed thickness 90 of the fork connector 44. In the fork connector disengaged position 88, the exterior clamping surface 54 of the first clamping member 18 and the second tab 82 of the first contact member 14 are spaced apart relative to the fork connector engaged position 86, the distance being somewhat greater than the undeformed thickness 90 of the fork connector 44.

With specific reference to FIGS. 4–6, in the most preferred embodiment, the second contact member 16 has a second tab 92 extending perpendicularly therefrom. The second tab 92 of the second contact member 16 is spaced from the first tab 66 of the second contact member 16. The second tab 92 of the second contact member 16 and the exterior surface 70 of the second clamping member 20 define a fork connector receiving space 94 therebetween.

With further reference to FIGS. 4–6, in addition to being movable between wire engaged and wire disengaged positions 80, 78, the second clamping member 70 is also movable between a fork connector engaged 96 and a fork connector disengaged position 98. The exterior clamping surface 70 of the second clamping member 20 securely engages a fork connector inserted into the fork connector receiving space 94 against the second tab 92 of the second contact member 16 in the fork connector engaged position 96. The distance between the exterior clamping surface 70 of the second clamping member 20 and the second tab 92 of the second contact member 16 being equal to, or slightly smaller than the undeformed thickness of the fork connector. In the fork connector disengaged position 98, the exterior clamping surface 70 of the second clamping member 20 and the second tab 92 of the second contact member 20 are spaced apart relative to the fork connector engaged position 96, the distance being somewhat greater than the undeformed thickness of the wire.

With general reference to FIGS. 1–9, the body portions 26, 28 of the housing 12, the contact members 14, 16, the clamping members 18, 20 and the clamping slots 56, 72 may be dimensioned such that the wire engaged positions 64, 80 and the fork engaged positions 86, 96 occur at the same position of the clamping member 18, 20 relative to the housing 12. A detent (not shown) may be provided at this point.

The clamping members 18, 20 and clamping slots 56, 72 may be dimensioned such that the second tabs 82, 92 serve as a stop for the exterior clamping surface 54, 70 of the clamping members 18, 20 to prevent over tightening and thereby preventing a wire 38 inserted in the wire receiving space 60, 76 from being crashed or damaged. The clamping slot 56, 72 may be dimensioned such that the first tab 50, 66 of the contact member 14, 16 serves as a stop for the interior clamping surface 58, 74 of the clamping slot 56, 72 to prevent over tightening thereby preventing a fork connector 44 inserted in the fork connector receiving space 84, 94 from being crushed or damaged.

With specific reference to FIGS. 3, 5–7, in the most preferred embodiment, the means for moving the first clamping member relative to the first contact member employs a first knob 100 having a head 102 and a threaded shaft 104. The head 102 of the first knob 100 is formed of an electrically insulating or non-conducting material. Polyamide plastic is a suitable material for forming the head 102 of the first knob 100. The threaded shaft 104 extends from the head 102 of the first knob 100 and is formed of an electrically conductive material. Brass is a suitable material for forming the threaded shaft 104 of the first knob 100.

With continuing reference to FIGS. 3, 5–7, the shaft 104 of the first knob 100 is rotatably received in a shaft receiving aperture 106 defined in the first body portion 26 of the housing 12. The portion of the head 102 of the first knob 100 from which the shaft 104 extends is mounted flush with the first body portion 26 such that the shaft 104 of the first knob 100 is not exposed. The first body portion 26 has a raised lip 108 which is concentric with the shaft receiving aperture 106 thereof and which is dimensioned to surround the head 102 of the first knob 100. The shaft 104 of the first knob 100 is also rotatably received through a shaft receiving opening 110 defined in the first contact member 14. The shaft 104 of the first knob 100 is in electrical contact with the first contact member 14. The threads of the shaft 104 of the first knob 100 threadedly engage a threaded aperture 112 defined in the first clamping member 18.

With specific reference to FIGS. 4–6, likewise, the means for moving the second clamping member 20 relative to the second contact member 18 employs a second knob 114 having a head 116 and a threaded shaft 118. The head 116 of the second knob 114 is formed of an electrically insulating or non-conducting material. Polyamide plastic is a suitable material for forming the head 116 of the second knob 114.

The threaded shaft 118 extends from the head 116 of the second knob 114 and is formed of an electrically conduction material. Brass is a suitable material for forming the threaded shaft 118 of the second knob 114.

With continuing reference to FIGS. 4–6, the shaft 118 of the second knob 114 is rotatably received in a shaft receiving aperture 120 defined in the second body portion 28 of the housing 12. The portion of the head 116 of the second knob 114 from which the shaft 118 extends is mounted flush with the second body portion 28 such that the shaft 118 of the second knob 114 is not exposed. The second body portion 28 has a raised lip 122 which is concentric with the shaft receiving aperture 120 thereof and which is dimensioned to surround the head 116 of the second knob 114. The shaft 118 of the second knob 114 is also rotatably received through a shaft receiving opening 124 defined by the second contact member 16. The shaft 118 of the second knob 114 being in electrical contact with the second contact member 16. The threads of the shaft 118 of the second knob 114 threadedly engage a threaded aperture 126 defined by the second clamping member 20.

With general reference to FIGS. 3–9, the clamping slot 56, 72 and contact member 16, 16 may be dimensioned such that the first tab 50, 66 of the contact member 14, 16 serves as a stop of the interior surface 58, 74 of the clamping slot 56, 72 thereby preventing the clamping member 18, 20 from being threaded off of the threaded shaft 104, 118 of the knob 100, 114.

Other means for moving the clamping member 18, 20 can include a spring (not shown) received in the cavity 30, 32 of the body portion 26, 28 which bias the clamping member 18, 20 into the wire engaged position 64, 80 and fork connector engaged position 86, 96. An elongated member (also not shown) is included, which extends between the clamping member 18, 20 and the exterior 34 of the body portion 26, 28 for allowing the clamping member 18, 20 to be selectively moved into the wire disengaged position 62, 78 and the fork connector disengaged position 88, 98, against the bias of the spring.

With reference to FIGS. 3–6, means for selectively mounting a standard banana plug 128 are provided in the most preferred embodiment. A first banana plug receiving aperture 130 is defined in the head 102 and shaft 104 of the first knob 100. The first banana plug receiving aperture 130 is sized and dimensioned to securely receive a banana plug 128 therein. The shaft 104 of the first knob 100 is in electrical contact with the first contact member 14, such that when a banana plug 128 is inserted into the first banana plug receiving aperture 130 a circuit is completed between the wire attached to the banana plug 128 and the first contact member 14. A similar approach is used for the second knob 114 and the second contact member 16 and a second banana plug receiving aperture 136.

Figure 8:
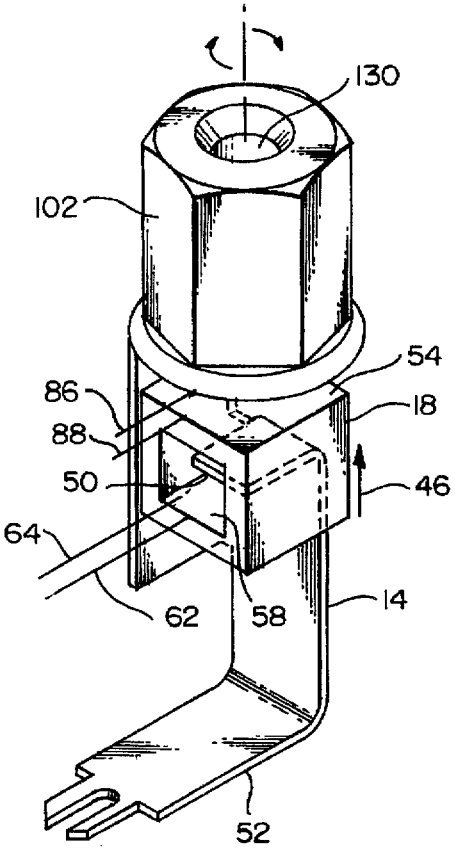
FIG. 8 is an exploded view of the terminal binding post of FIG. 1 in the wire engaged position and fork connector engaged position.
Figure 9:
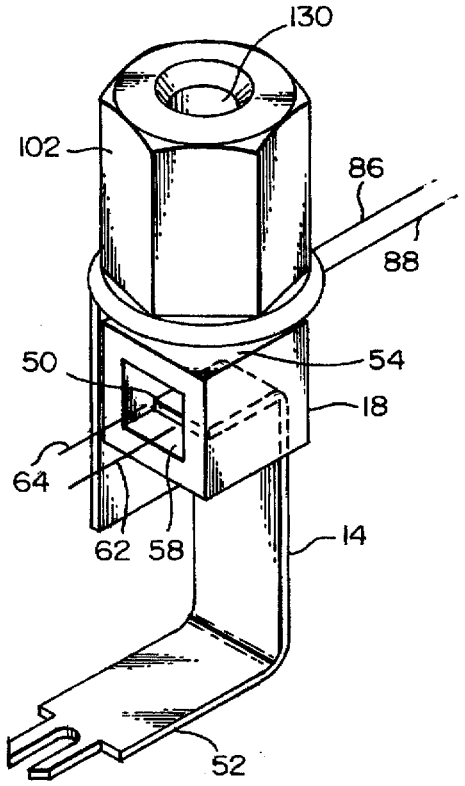
FIG. 9 is an exploded view of the terminal binding post of FIG. 1 in the wire disengaged position and the fork connector disengaged position.
Figure 10:
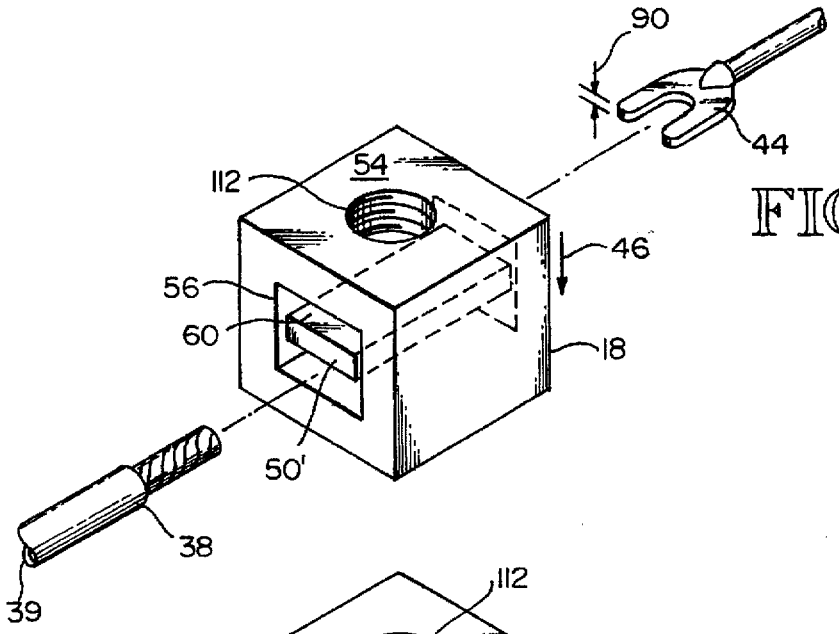
FIG. 10 is a portional view showing the clamping member and the contact member of the alternative of the first embodiment of the terminal binding post.

With reference to FIGS. 8–10, the position of the first tab 50 in the clamping slot 56 of the first clamping member 18 may be varied such that a wire 38 inserted into the wire receiving space 60 will be securely engaged by movement of the first clamping member 18 in either direction with respect to the housing 12. In the most preferred embodiment, the first tab 50 is spaced relatively close to the first knob 100. This permits the wire 38 to be secured against the first tab 50 by the first clamping member 18 when a clockwise motion is applied to knob 100. This position produces a more intuitive response for the person using the terminal binding post 10. Alternatively as shown specifically in FIG. 10, the first tab 50' can be spaced relatively away from the first knob 100. In such a case, a counterclockwise turning of the first knob 100 would cause the first clamping member 18 to secure the wire 38 against the first tab 50' of the first contact member 14.

With general reference to FIGS. 1–6, a first color ring 132 and a second color ring 134 are provided for being selectively mounted to the raised lip 108 of the first body portion 26 and the raised lip 122 of the second body portion 28. The first color ring 132 is preferably red and the second color ring 134 is preferably black. The color rings 132, 134 may be interchanged to match the appropriate polarity of each body portion 26, 28 of the terminal binding post 10, such as red for positive and black for negative.

Figure 11:
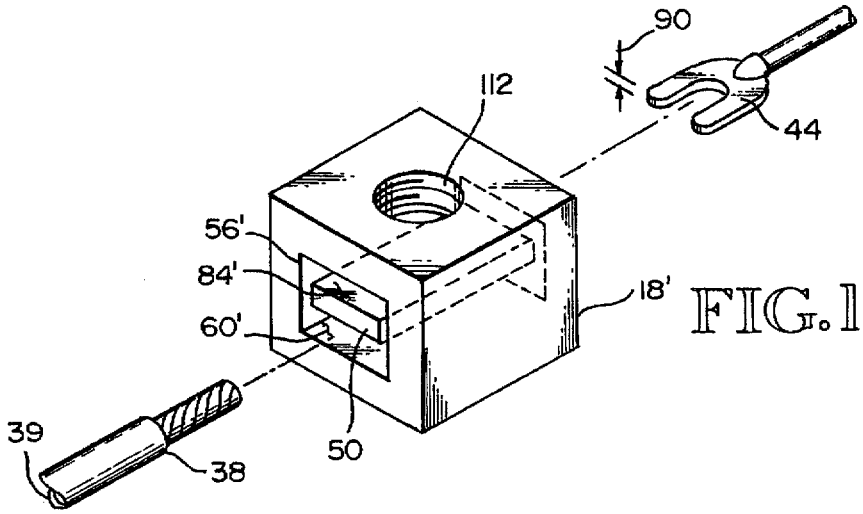
FIG. 11 is a portional view showing the clamping member and the contact member of the second embodiment of the terminal binding post.

A second embodiment of the terminal binding post 10 is shown in FIG. 11. This alternative embodiment will be discussed with reference to only one half of the entire structure. As in the previous discussion, the other half of the structure has similar construction to the first half.

In the second embodiment, the clamping slot 56' must extend completely through the first clamping member 18'. The first tab 50' is located in a substantially centered position within the clamping slot 56' of the first clamping member 18'. The interior clamping surface 58' of the first clamping member 18' and the first tab 50' define a wire receiving space 60' and a fork connector receiving space 84' therebetween. The wire receiving space 60' and the fork connector receiving space 84' are defined on opposite sides of the first tab 50'. Therefore, opposite movements of the first clamping member 18' with respect to the first contact member 14 will cause the first clamping member 18' to move into the wire engaged position 64' and the fork connector engaged position 86'. The aperture 36 and the slot 42 are defined opposite each other in the first body portion 26 such that they communicate with the wire receiving space 60' and the fork connector receiving space 84' respectively.

Figure 12:
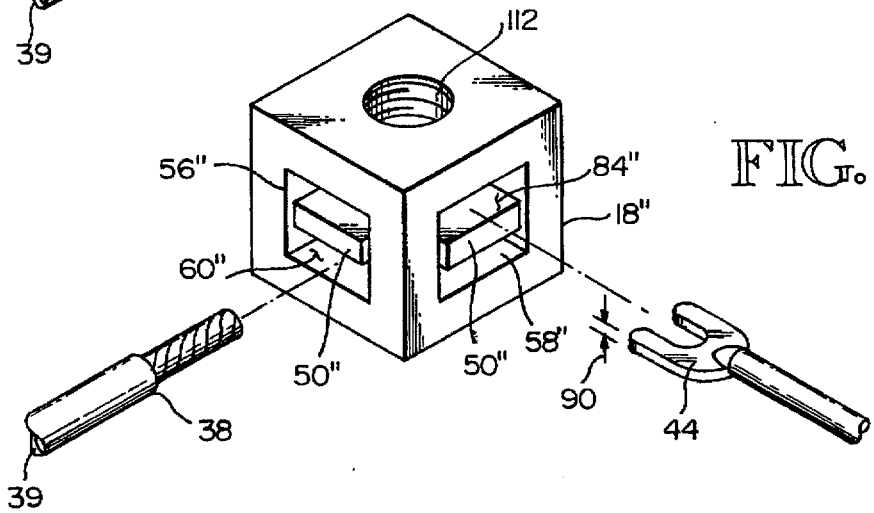
FIG. 12 is a portional view showing the clamping member and the contact member of the third embodiment of the terminal binding post.

A third embodiment of the terminal binding post is shown in FIG. 12. This alternative embodiment will be discussed with reference to only one half of the entire structure. The other half of the structure having similar construction to the first half.

In the third embodiment, the clamping slot 56" is L-shaped or V-shaped, having an included angle of not more than 90 degrees. As in the second embodiment, the first tab 50" is located in a substantially centered position within the clamping slot 56" of the first clamping member 18". The interior clamping surface 58" of the first clamping member 18" and the first tab 50" define a wire receiving space 60" and a fork connector receiving space 84" therebetween. The wire receiving space 60" and the fork connector receiving space 84" are defined on opposite sides of the first tab 50". Therefore, opposite movements of the first clamping member 18" with respect to the first contact member 14 will cause the first clamping member 18" to move into the wire engaged position 64 and the fork connector engaged position 86. The aperture 36 and the slot 42 are defined at an angle not greater than 90 degrees to each other in the first body portion 26 such that they communicate with the wire receiving space 60" and the fork connector receiving space 84" respectively.

It is of course possible to vary the placement of the first tab 50" in the clamping slot 56" of the third embodiment in a similar fashion as that shown in the first embodiment and its alternatives. While such variation is not preferred since it would complicate the geometry of the contact member 14 such variation should be considered within the scope of this invention. In compliance with the statutes, the invention has been described in language more or less specific as to structural features and process steps. While this invention is susceptible to embodiment in different forms, the specification illustrates preferred embodiments of the invention with the understanding that the present disclosure is to be considered an exemplification of the principals of the invention, and the disclosure is not intended to limit the invention to the particular embodiments described. Those with ordinary skill in the art will appreciate that other embodiments and variations of the invention are possible which employ the same inventive concepts as described above. Therefore, the invention is not to be limited except by the claims which follow.

I claim:

1. A terminal binding post for selectively mounting a wire and a fork connector thereto, the terminal binding post which comprises:

a housing formed of an electrically non-conductive material, a perimeter wall of the housing defining a cavity therein and an exterior thereout, the perimeter wall of the housing further defining an aperture extending between the exterior and the cavity of the housing, the aperture sized and dimensioned to receive the wire therethrough and a slot extending between the exterior and cavity of the housing, the slot sized and dimensioned to receive the fork connector therethrough;

a contact member received within the cavity of the housing, the contact member having a first tab, the contact member formed of an electrically conductive material;

a clamping member having an exterior clamping surface and a clamping slot defined therein, the clamping slot defining an interior clamping surface, the first tab of the contact member received in the clamping slot, the clamping slot and the first tab defining a wire receiving space therebetween, the clamping member and the contact member further defining a fork connector receiving space therebetween, the fork connector receiving space separate from the wire receiving space, the clamping member received in the cavity of the housing for movement therein with respect to the contact member between a wire engaged position in which the clamping member securely engages the wire against the first tab and a wire disengaged position spaced from the wire engaged position, a fork connector engaged position in which the clamping member securingly engages the fork connector against the contact member and a fork connector disengaged position in which the clamping member is spaced from the fork connector engaged position;

means for moving the clamping member between the wire engaged position, the wire disengaged position, the fork connector engaged position and the fork connector disengaged position.

2. The terminal binding post of claim 1 wherein:

the aperture is collinear with the wire receiving space and the slot is coplanar with the fork connector receiving space.

3. The terminal binding post of claim 2 wherein:

the contact member has a second tab spaced from the first tab and the fork connector receiving space is defined between the second tab of the contact member and the exterior clamping surface of the clamping member.

4. The terminal binding post of claim 3 wherein the clamping member moving means comprises:

a shaft receiving aperture defined in the housing;

a threaded aperture defined in the clamping member; and a knob, the knob having a head formed from an electrically insulating material and a threaded shaft, the shaft of the knob rotatably received through the shaft receiving aperture and threadedly engaging the threaded aperture of the clamping member.

5. The terminal binding post of claim 4 further comprising means for selectively mounting a banana plug.

6. The terminal binding post of claim 5 wherein the banana plug mounting means comprises:

a banana plug receiving aperture defined in the head and the shaft of the knob sized and dimensioned to securingly receive a banana plug therein wherein the shaft of the knob is formed of an electrically conductive material.

7. A terminal binding post which comprises:

a housing having a body portion and a base, the body portion having a perimeter wall formed of an electrically insulating material defining a cavity therein and an exterior thereout, an aperture defined in the perimeter wall extending between the cavity and the exterior, the aperture sized and dimensioned to selectively receive a wire therein, a slot defined in the perimeter wall extending between the cavity and the exterior, the slot sized and dimensioned to selectively receive a fork connector therein;

a contact member formed of an electrically conducting material having a first tab, the contact member received in the cavity of the body portion such that the contact member does not extend beyond the perimeter wall of the body portion;

a clamping member having an exterior clamping surface and a clamping slot defined therein for receiving the first tab of the contact member, the clamping slot defining an interior clamping surface therein, the clamping member received within the cavity of the body portion for movement therein with respect to the contact member between a wire engaged position in which a wire receiving space defined between the first tab of the contact member and the interior clamping surface of the clamping member is less than a diameter of the wire and a wire disengaged position in which the wire receiving space is greater than the diameter of the wire; and means for moving the clamping member relative to the contact member between the wire disengaged position and the wire engaged position.

8. The terminal binding post of claim 7 wherein:

a fork connector receiving space is defined between the first tab of the contact member and the interior clamping surface of the clamping member such that the fork connector receving space is separate from the wire receiving space; and the clamping member is further movable with respect to the contact member between a fork connector engaged position in which the fork connector receiving space is less than a thickness of the forked connector and a fork connector disengaged position in which the fork connector receiving space is greater than the thickness of the fork connector.

9. The terminal binding post of claim 7 wherein:

the contact member has a second tab spaced from the first tab;

a fork connector receiving space is defined between the second tab of the contact member and the exterior clamping surface of the clamping member such that the fork connector receiving space is separate from the wire receiving space; and the clamping member is further movable with respect to the contact member between a fork connector engaged position in which the fork connector receiving space is less than a thickness of the forked connector and a fork connector disengaged position in which the fork connector receiving space is greater than the thickness of the fork connector.

10. The terminal binding post of claim 9 wherein:

the aperture of the housing is aligned with the wire receiving space; and the slot of the housing is aligned with the fork connector receiving space.

11. The terminal binding post of claim 10 wherein the means for moving the clamping member relative to the contact member comprises:

a shaft receiving aperture defined in the housing;

a threaded aperture defined in the clamping member; and a knob, the knob having a head formed from an electrically insulating material and a threaded shaft, the threaded shaft of the knob rotatably received through the shaft receiving aperture and threadedly engaging the threaded aperture of the clamping member.

12. The terminal binding post of claim 11 further comprising:

means for selectively mounting a banana plug.

13. The terminal binding post of claim 12 wherein the banana plug mounting means comprises:

a banana plug receiving aperture defined in the head and the shaft of the knob, the banana plug receiving aperture sized and dimensioned to seemingly receive a banana plug therein, and wherein the shaft of the knob is formed of an electrically conductive material.

14. A terminal binding post which comprises:

a housing having a base and a body portion, the body portion having a perimeter wall defining a cavity therein and an exterior thereout, the perimeter wall formed of an electrically insulating material, an aperture defined in the perimeter wall extending between the cavity and the exterior, the aperture sized and dimensioned to selectively receive a wire therein, a slot defined in the perimeter wall extending between the cavity and the exterior, the slot offset from the aperture such that the slot does not intersect with the aperture, the slot sized and dimensioned to selectively receive a fork connector therein;

a contact member having a first tab and a second tab spaced from the first tab, the contact member received in the cavity of the body portion such that the contact member does not extend beyond the perimeter wall of the body portion;

a clamping member having an exterior clamping surface and a clamping slot, the clamping slot having an interior clamping surface, the first tab of the contact member received within the clamping slot such that the first tab of the contact member and the interior clamping surface of the clamping member define a wire receiving space therebetween, the second tab of the contact member and the exterior clamping surface defining a fork connector receiving space therebetween separate from the wire receiving space, the clamping member received within the cavity of the body portion for movement therein with respect to the contact member between a wire engaged position in which the interior clamping surface of the clamping member is spaced from the first tab of the contact member by a distance less than a diameter of the wire and a wire disengaged position in which the interior clamping surface of the clamping member is spaced from the first tab of the contact member by a distance greater than the diameter of the wire and for movement between a fork connector engaged position in which the exterior clamping surface of the clamping member is spaced from the second tab of the contact member by a distance less than a thickness of the fork connector and a fork connector disengaged position in which the exterior clamping surface of the clamping member is spaced from the second tab of the contact member by a distance greater than the thickness of the fork connector; and means for moving the clamping member relative to the contact member between the wire disengaged position and the wire engaged position and for moving the clamping member relative to the contact member between the fork connector disengaged position and the fork connector engaged position.

15. A terminal binding post for selectively mounting a pair of wires, a pair of fork connectors and a pair of banana plugs thereto, the terminal binding post which comprises:

a housing having a base and a perimeter wall formed of an electrically insulating material, the perimeter wall defining a first body portion having a first cavity defined therein and a second body portion having a second cavity defined therein, a first aperture defined in the perimeter wall extending into the first cavity and a second aperture defined in the perimeter wall extending into the second cavity, each of the first aperture and the second aperture sized and dimensioned to receive a respective one of the pair of wires therein, a first slot defined in the perimeter wall extending into the first cavity and a second slot defined in the perimeter wall extending into the second cavity, each of the first slot and the second slot sized and dimensioned to receive a respective one of the pair of fork connectors therein, a first shaft receiving aperture defined in the perimeter wall extending into the first cavity and a second shaft receiving aperture defined in the perimeter wall extending into the second cavity;

a first contact member, the first contact member received within the first cavity of the housing such that no portion of the first contact member extends beyond the perimeter wall of the housing, the first contact member having a first tab and a second tab;

a second contact member, the second contact member received within the second cavity of the housing such that no portion of the second contact member extends beyond the perimeter wall of the housing, the second contact member having a first tab and a second tab;

a first clamping member having a threaded aperture defined therein, the first clamping member received within the first cavity of the housing for movement therein with respect to the first tab of the contact member between a wire engaged position and a wire disengaged position;

a second clamping member having a threaded aperture defined therein, the second clamping member received within the second cavity of the housing for movement therein with respect to the second contact member between a fork connector engaged position and a fork connector disengaged position;

a first knob, the first knob having a head formed from an electrically insulating material and a threaded shaft formed from an electrically conducting material, the threaded shaft dimensioned to securingly receive one of the pair of fork connector thereabout, the shaft of the first knob rotatably received through the first shaft receiving aperture and threadedly engaging the threaded aperture of the first clamping member, the head and shaft of the first knob defining a banana plug receiving aperture therein, the banana plug aperture sized and dimensioned to securingly receive a standard banana plug; and a second knob, the second knob having a head formed from an electrically insulating material and a threaded shaft formed from an electrically conducting material, the threaded shaft dimensioned to securingly receive one of the pair of fork connector thereabout, the shaft of the second knob rotatably received through the second shaft receiving aperture and threadedly engaging the threaded aperture of the second clamping member, the head and shaft of the second knob defining a banana plug receiving aperture therein, the banana plug aperture sized and dimensioned to securingly receive a standard banana plug.

16. The terminal binding post of claim 15 further comprising:

a first color ring releasably secured to the first body portion concentric about the head of the first knob; and a second color ring releasably secured to the second body portion concentric about the head of the second knob.

* * * * *